United States Patent [19]

Meggs et al.

[11] 3,990,183

[45] Nov. 9, 1976

[54] SLIDING DOOR ASSEMBLY

[75] Inventors: Daniel H. Meggs; Janos Beny, both of Torrance, Calif.

[73] Assignee: Columbia Manufacturing Corporation, Gardena, Calif.

[22] Filed: July 29, 1974

[21] Appl. No.: 492,517

[52] U.S. Cl. ..... 49/125; 49/257; 49/411

[51] Int. Cl.[2] ..... E05D 15/58; E05D 13/02

[58] Field of Search ..... 49/254, 260, 409–412, 49/125, 127, 258, 257, 259; 160/205; 16/96 R, 96 L, 95 R, 97, 98; 4/146–149, 154; 104/110, 93; 105/156

[56] References Cited

UNITED STATES PATENTS

| | | | |
|---|---|---|---|
| 1,188,482 | 6/1916 | Phillips | 49/257 X |
| 1,809,093 | 6/1931 | Willard | 49/257 X |
| 2,766,857 | 10/1956 | Miller | 49/411 |
| 3,063,496 | 11/1962 | Kessler | 49/257 X |
| 3,101,485 | 8/1963 | Kirshenbaum | 16/96 R X |
| 3,235,915 | 2/1966 | Glaser | 49/127 X |
| 3,309,816 | 3/1967 | Malone, Jr. | 49/411 X |
| 3,744,827 | 7/1973 | Cox | 49/411 X |

*Primary Examiner*—Philip C. Kannan

[57] ABSTRACT

Doors are slidably mounted in tracks by structure which cooperates with and follows the course of the tracks even around sharp corners and curves to permit sliding of the doors into out of the way storage positions. The sliding door assembly is illustrated forming a bathtub/shower enclosure.

5 Claims, 9 Drawing Figures

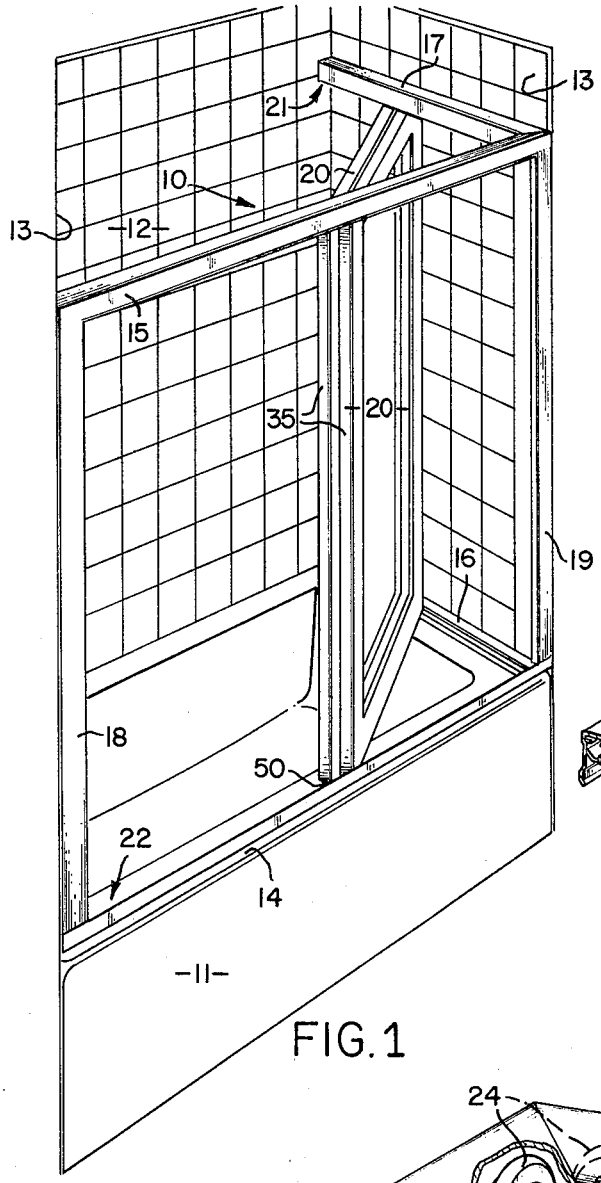
FIG. 1
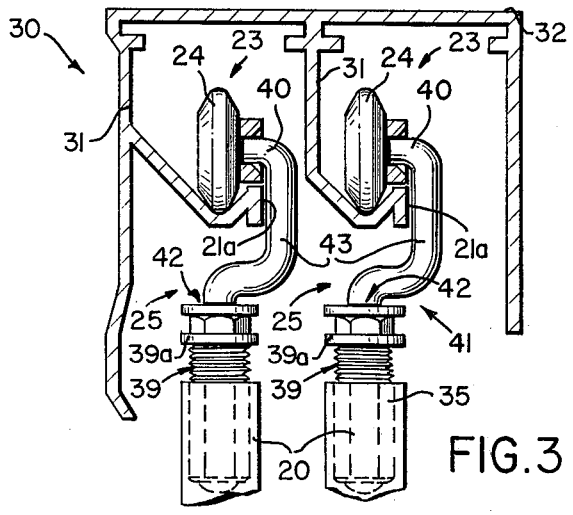
FIG. 3
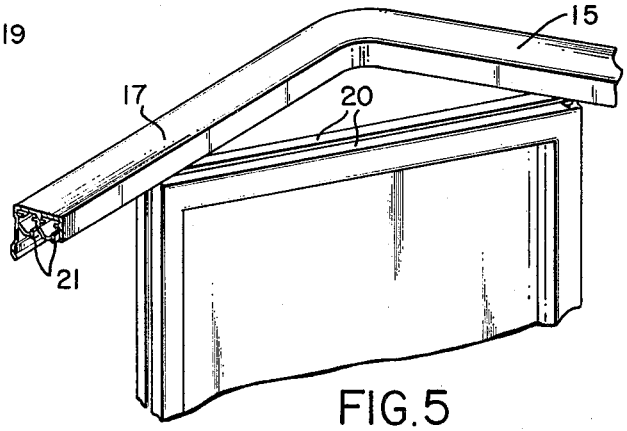
FIG. 5
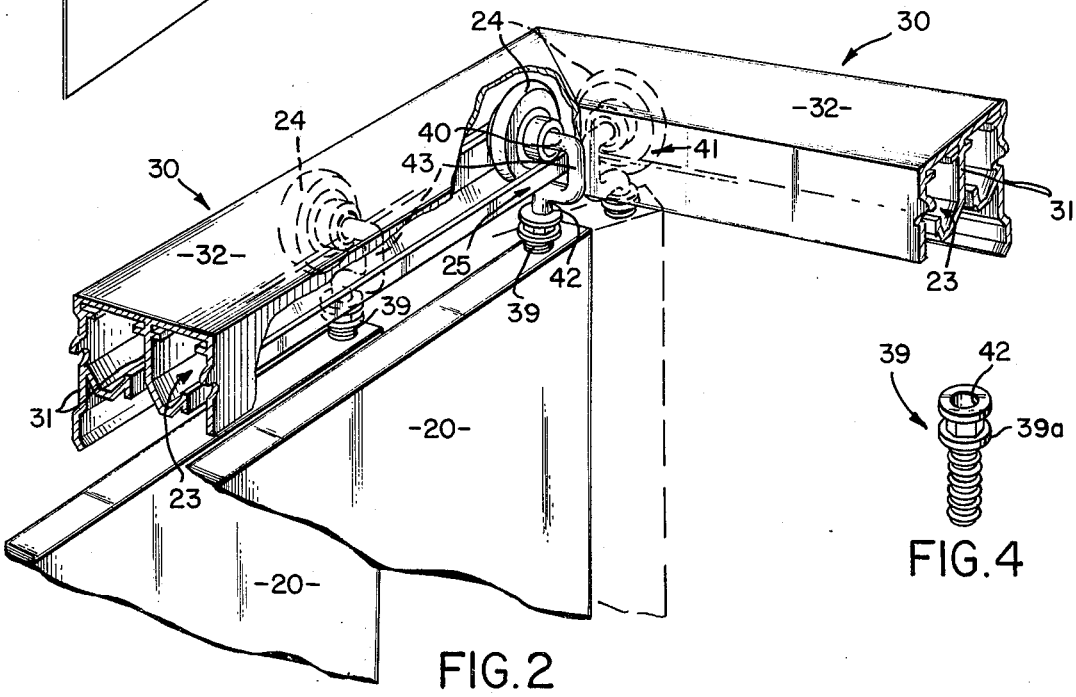
FIG. 2
FIG. 4

FIG.6
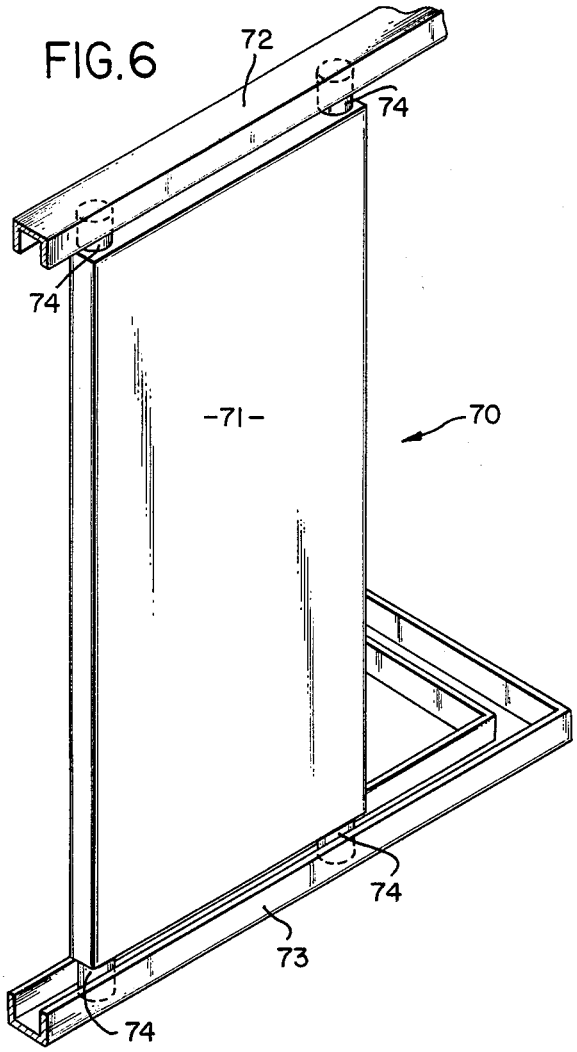
FIG.7
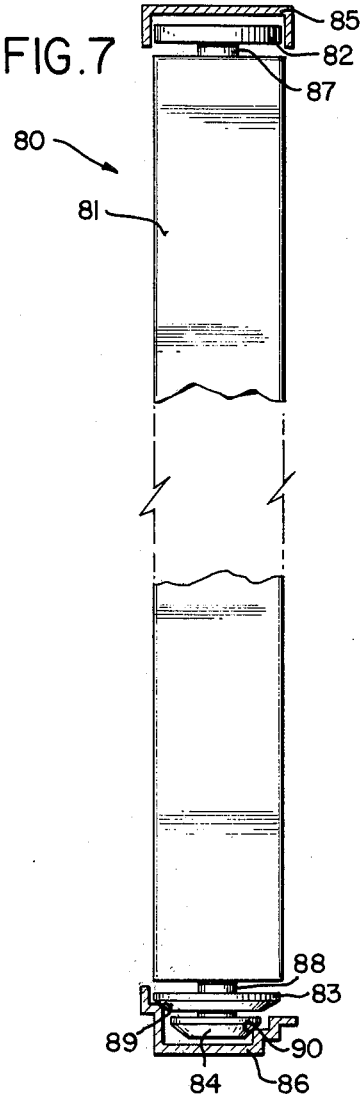
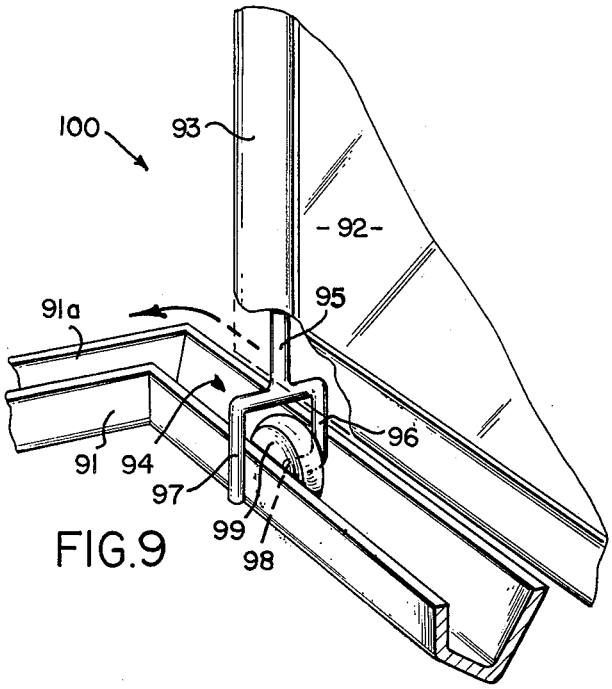
FIG.9
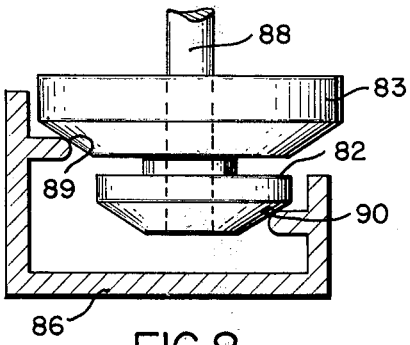
FIG.8

SLIDING DOOR ASSEMBLY

BACKGROUND OF THE INVENTION

The present invention relates to doors and more particularly sliding door assemblies.

SUMMARY OF THE INVENTION

It is an object of the present invention to provide an improved sliding door assembly characterized by being arranged to permit the sliding of its doors into out of the way storage positions to facilitate cleaning and easy access to the area closed off by the doors.

It is further an object of the present invention to provide an improved door assembly as set forth characterized by having its doors slidably mounted by pivotal rollers which cooperate with and follow the course of the tracks even around shrp corners and curves to permit the sliding of the doors into the out of the way storage positions.

It is additionally an object of the present invention to provide an improved pivotal roller assembly for slidably mounting doors.

It is also an object of the present invention to provide an improved door assembly characterized by being mounted in tracks on rollers which independently rotate about a vertical axis to permit the sliding of the doors around corners and curves in the tracks into out of the way storage positions.

In accomplishing these and other objects, there is provided in accordance with the present invention several embodiments of sliding door assemblies. In one embodiment, the doors are slidably mounted in overhead tracks by being suspended therefrom by pivotal hangers. The pivotal hangers cooperate with and follow the course of the tracks around corners and curves to permit sliding of the doors into out of the way storage positions. In this embodiment, the sliding door assembly is illustrated forming a bathtub/shower enclosure and guide structure is associated with the door bottoms to prevent the doors from swinging.

In a second embodiment, the doors are mounted in tracks on guides which slide and follow their associated tracks around corners and curves.

In another embodiment, the doors are mounted in tracks by rollers which independently rotate about a vertical axis.

In yet another embodiment of sliding door assembly, the lower edge of the door is mounted in a track by rollers which are pivotal about a substantially vertical axis to follow the course of track around curves and corners therein.

Additional objects of the present invention reside in the construction of the sliding door assemblies shown in the drawings and hereinafter described.

BRIEF DESCRIPTION OF THE DRAWINGS

FIG. 1 is a perspective view of a sliding door assembly according to the present invention illustrated forming a bathtubshower enclosure.

FIG. 2 is a cutaway perspective view showing the overhead tracks in the upper corner of the sliding door assembly of FIG. 1 illustrating by solid-phantom line representation the manner in which one of the pivotal hangers on the associated door rotates to follow the course of its associated track to permit sliding of the door around the corner.

FIG. 3 is a cross-sectional view of the overhead tracks of FIG. 2 illustrating the wheels of the pivotal door hangers riding therein.

FIG. 4 is a perspective view of one of the adjustable inserts employed to secure the pivotal door hangers to their associated door.

FIG. 5 is a perspective view illustrating the upper corner of the sliding door assembly of the present invention formed as a curve.

FIG. 6 is a perspective view of another embodiment of sliding door assembly according to the present invention.

FIG. 7 is a side elevation view of yet another embodiment of sliding door assembly of the present invention.

FIG. 8 is an enlarged side elevation view of the bottom rollers of the sliding door assembly of FIG. 7.

FIG. 9 is a perspective view of still another embodiment of sliding door assembly according to the present invention.

DETAILED DESCRIPTION OF THE PREFERRED EMBODIMENTS

Referring to the drawings in more detail, there is shown in FIG. 1 a sliding door assembly generally identified by the number 10 mounted to form a bathtub/-shower enclosure.

The bathtub/shower is formed by a tub 11 positioned in a stall or recess defined by vertical back wall 12 and vertical side walls 13.

Frame structure for supporting the sliding door assembly 10 is provided by horizontal extending frame members 14, 15, 16, 17 and vertical extending frame members 18, 19.

The sliding door assembly 10 illustrated in FIG. 1 is formed by a pair of doors 20 slidably mounted in a pair of substantially parallel horixontally extending upper and lower tracks 21 and 22, respectively.

The upper or overhead tracks 21 are mounted in the frame structure 15, 17 one parallel disposed behind the other in the manner shown by the cross-sectional views of FIGS. 3 and 4. As there shown, each track 21 defines an upwardly opening V-shaped channel 23 for receiving the wheel 24 of a pivotal door hanger roller 25. Further, the inner portion of the V-shaped channel 23 is of longer length than its outside portion to permit the wheels 24 to turn around the corner in the tracks 21 without scrubbing the sides of the channel 23.

The course of the track 21 shown in FIG. 2 is formed by members 30 having downwardly extending rib portions 31 which support the V-shaped guide channels 23. The members 30 illustrated in FIG. 2 are joined to form a right angled corner, although they could be bent, as shown in FIG. 5, to form a corner in the shape of a curve. It is noted, as shown in FIG. 3, that the wheel or tire 24 of the pivotal hanger 25 has a curvature which effortlessly follows the track 21 around curves and corners. The upper portion 32 of the members 30 is secured to or formed as an integral part of the frame structure 15, 17.

Mounted to extend at horizontally spaced apart positions from the upper end of each door 20 are two pivotal door hangers or rollers 25. The hangers 25 are preferably mounted adjacent each vertical side edge 35 of the door 20 so that as the doors slide around a corner their vertical edges track in and follow the vertical plane defined by the structure forming the channel 23. Thereby, as one door 20 slides around the corner in track 21, its edges will not jut out and hit the vertical shower wall 13 or the other door 20.

As shown in FIGS. 2 and 3, the pivotal hanger 25 has its wheel 24 rotatably mounted on a horizontally extending shaft 40 provided by a wire form 41. The wire form or member 41 is pivotally mounted on its lower end at point 42 in the insert structure 39 to rotate about a vertical axis. The insert structure 39 is shown in greater detail in FIG. 4 and are threaded into the door 20. The wire form 41 extends upwardly verically from pivotal mounting point 42 in the insert 39 and bends to form a central crank portion 43 which extends around the flat outer portion 21a of the associated track 21. It is noted that the central crank portion 43 of the bent wire form 41 preferably extends vertically. Further the upper portion 39A of the inserts 39 are preferably formed like hexagonally shaped nuts to permit rotation thereof to adjust the height of the hangers 25.

The pivotal hangers 25 operate in the following manner to permit a door 20 to be slid around a corner in the track 21. As shown in FIG. 2, when the pivotal hanger 25 encounters the corner of the track 21, its central crank portion 43 engages or strikes the structure defining the guide channel 23. This causes the wire form 41 to be rotated vertically in the insert 39 at pivotal mounting point 42 with the result that the wheel 24 rolls around the corner in the track 21. In this manner the doors 20 may be easily slid around corners or curves in the tracks 21. Thus, the doors 20 may be conveniently pushed into a storage position against the vertical shower wall 13 or moved therefrom to close the bathtub/shower.

It is noted that guide structure 50, such as rollers which rotate along a vertical axis, is associated with the bottom of the doors 20 which engages the lower tracks 22. This guide structure 50 prevents the doors from swinging.

Referring to FIG. 6, the sliding door assembly there shown is identified by the numberal 70. The assembly 70 includes a door 71 mounted in upper and lower tracks 72 and 73 by fixed cylindrical guides 74. The tracks 72 and 73 are preferably formed as U channels and the guides 74 extend vertically from the upper and lower edges of the door 71. The guide 74 will follow the tracks 72 and 73 around a corner to permit sliding of the door 71 into an out of the way storage position.

The embodiment of sliding door assembly shown in FIGS. 7 and 8 is generally identified by the numeral 80 and is made up of a door 81 mounted by rollers 82, 83, 84 in upper and lower tracks 85, 86. The roller 82 is rotatably mounted on the upwardly vertically extending shaft 87 while the rollers 83, 84 are mounted for independent rotation on the downwardly extending shaft 88. The underside outer edge of each of the rollers 83 and 84 is chamfered or cut at an angle to ride on the track edges 89 and 90 defined by the lower track 86. It is noted that the track edges 89 and its associated roller 83 are mounted above the track edge 90 and its associated roller 84. In operation, the door 81 may be easily slid around corners in the tracks 85, 86 since the rollers 82–84 operate to roll therearound. During sliding of the door 81, the rollers 83 and 84 rotate in opposite directions.

Referring to FIG. 9, the sliding door assembly there shown is generally identified by the numeral 100. The assembly 100 includes a door 92. The door 92 is illustrated slidably mounted in a lower track 91 by means of a pivotal roller assembly 94. The roller assembly 94 includes a downwardly extending shank 95 which is pivotally mounted to extend from the lower edge of the door side portion 93. Formed on the lower end of the shank 95 is a downwardly extending fork which forms a crank arm 97 and an arm 96 for carrying roller wheel 99. The arm 96 has a horizontal extension 98 on its lower end which provides a shaft 40 for the wheel 99.

The wheel 99 is shown positioned to ride in the V-shaped channel 91a defined by the track 91. In operation, as the door 92 is slid toward the corner in the track 91, the wheel 99 rotates in the track 91a. When the roller assembly 94 reaches the corner in the track 91, the crank 97 engages the side wall of the track 91 wth the result that the roller assembly pivots about its vertical axis defined by the shank 95 to rotate the wheel 99 around the corner in the track 91.

It is noted that the various structure means shown in the different embodiments of sliding door assemblies for mounting the doors in the upper and lower tracks may be used together in any suitable combination.

Although the invention has herein been shown and described in which is conceived to be the most practical and preferred embodiments, it is recognized that departures may be made therefrom within the scope of this invention. It is noted that while the invention was illustrated in forming a bathtub/shower enclosure that sliding door assemblies in accordance therewith may be used for cabinet, wardrobe or any other doors where space saving is desired or required, e.g. mobile homes, campers.

We claim:

1. In a sliding door assembly wherein a door is slidably mounted in an overhead track, the improvement comprising a pair of horizontally spaced apart pivotal hanger means mounted on said door to extend upwardly therefrom for suspending said door from said overhead track, each of said hanger means being cooperable with said overhead track to slide therealong and being pivotal about a substantially vertical axis to follow the course of said track around curves and corners therein;

said overhead track defining an upwardly opening guide channel;

each of said hanger means including rotatably mounted wheel which rides in said guide channel; and each of said hanger means including structure secured to said door and a member pivotally mounted on said structure for rotational movement about the vertical axis, said member defining on its upper end a substantially horizontally extending axis upon which said wheel is rotatably mounted and having a central crank portion which bends around the guide channel formed in said overhead track, said central crank portion being dimensioned and shaped to strike said overhead track whenever the wheel of said hanger means reaches a corner in said overhead track whereby the force of said overhead track against said central crank portion causes said hanger means to rotate thereby to aid the movement of the wheel of said hanger means around a corner in said overhead track.

2. The invention defined in claim 1 wherein said guide channel has a substantially V-shape.

3. The invention defined in claim 2 including guide structure means associated with the bottom of said door for preventing said door from swinging.

4. The invention defined in claim 3 wherein said sliding door assembly includes at least two doors mounted by said hanger means in side by side horizontally spaced apart substantially parallel overhead tracks.

5. In a sliding door assembly wherein a door is slidably mounted in an overhead track, the improvement comprising a pair of horizontally spaced apart pivotal hanger means mounted on said door to extend upwardly therefrom for suspending said door from said overhead track, each of said hanger means being cooperable with said overhead track to slide therealong and being pivotal about a substantially vertical axis to follow the course of said track around curves and corners therein;

each of said hanger means including structure secured to said door and a member pivotally mounted on said structure for rotational movement about the vertical axis, said member having a central crank portion which bends around said overhead track, said central crank portion being dimensioned and shaped to strike said overhead track whenever said hanger means reaches a corner in said overhead track whereby the force of said overhead track against said central crank portion causes said hanger means to rotate thereby to aid sliding movement of said hanger means around a corner in said overhead track.

* * * * *